US005382174A

United States Patent [19]

Kinoshita

[11] Patent Number: 5,382,174

[45] Date of Patent: Jan. 17, 1995

[54] WATERPROOF ELECTRICAL CONNECTOR

[75] Inventor: Shoji Kinoshita, Kawasaki, Japan

[73] Assignee: The Whitaker Corporation, Wilmington, Del.

[21] Appl. No.: 89,879

[22] Filed: Jul. 9, 1993

[51] Int. Cl.[6] ..... H01R 13/52

[52] U.S. Cl. ..... 439/271; 439/595

[58] Field of Search ..... 439/271–283, 439/587, 352, 353, 586, 595, 596, 600

[56] References Cited

U.S. PATENT DOCUMENTS

| | | | |
|---|---|---|---|
| 4,109,989 | 8/1978 | Snyder, Jr. et al. | 439/274 |
| 4,710,135 | 12/1987 | Aoyama et al. . | |
| 4,758,174 | 7/1988 | Michaels et al. . | |
| 4,828,510 | 5/1989 | Muzslay . | |
| 5,083,933 | 1/1992 | Colleran et al. | 439/353 |
| 5,147,222 | 9/1992 | Hotea et al. . | |
| 5,151,052 | 9/1992 | McCardell | 439/595 |
| 5,252,088 | 10/1993 | Morello et al. | 439/595 |

FOREIGN PATENT DOCUMENTS

| | | |
|---|---|---|
| 214794 | 8/1986 | European Pat. Off. . |
| 388489 | 3/1989 | European Pat. Off. . |
| WO88/0371 | 5/1988 | WIPO . |

*Primary Examiner*—David L. Pirlot
*Attorney, Agent, or Firm*—Timothy J. Aberle

[57] ABSTRACT

This invention relates to a waterproof connector (100) provided with structure (306, 316) to prevent water from entering the electrical connection unit. The invention double locks the male housing (300) and achieves miniaturization by providing a latch arm (314) inserted into the engaging aperture (202) in the female housing (200). The male housing's (300) sides are surrounded by a seal member (316) slanted so that on the first side equipped with a latch arm (314) the seal member (316) is ahead of the latch arm (314) in the insertion direction, and on the other side where a double lock member (310) is inserted the seal member (316) is to the rear of the double lock member (310) in the insertion direction. The male member (300) is waterproof when engaged in the engaging aperture (202) of the female housing (200).

21 Claims, 5 Drawing Sheets

WATERPROOF ELECTRICAL CONNECTOR

This invention relates to a waterproof connector provided with a structure that prevents fluids such as water, oil, etc. from entering an electrical connection.

BACKGROUND OF THE INVENTION

Various types of connectors are used as a means for mutually connecting electrical and electronic circuits. Among these are waterproof connectors used to prevent water from entering an electrical connection.

FIG. 7 is a cross-sectional view showing one example of a conventional waterproof connector.

The prior waterproof connector 10 consists of a female housing 20 and male housing 30, which is inserted from the aperture in female housing 20. Contact 22, which is electrically connected to lead 1 inside female housing 20, is locked by lance 23, and pin-shaped tip 22*a* extends inside aperture 21. Meanwhile, female contact 32, which is electrically connected to lead 2 inside male housing 30, is locked by lance 33 and inserted. Male housing 30 is also equipped with latch arm 34. When engaged, latch arm 34 is locked with lock unit 25 on female housing 20, and this prevents the engagement from coming apart accidentally.

In this case, when engagement occurs by inserting male housing 30 into aperture 21 in the female housing, tip 22*a* is inserted into female contact 32, thus mutually and electrically connecting lead 1 and lead 2.

In this case, seal member 24 is provided inside aperture 21, and this prevents water from entering the electrical connection unit of both housing 20 and 30. Entry of water is also prevented by seal member 26 at the rear end (relative to the engagement direction) of female housing 20, and by seal member 36 at the rear end (relative to the engagement direction) of male housing 30.

If seal member 24's adhering surface is damaged when male housing 30 is engaged, adhesion may deteriorate and water may enter, so male housing 30 is equipped with hood 37 in order to protect this surface.

In the known conventional waterproof connector 10 described above, connectors 22 and 32 are each locked only by lances 23 and 33; it is preferable that they be double-locked by providing two locking units to keep connectors 22 and 32 from coming out. Instead of a double lock, the waterproof connector 10 is provided with lance securing members 28 and 38 to secure lances 23 and 33, but essentially this is not double locking, and it is preferable to improve the reliability of preventing contacts 22 and 32 from coming out.

Also, latch arm 34 is structured so that it is positioned outside the outer wall of female housing 20 when engaged, and hood 37 needs to be positioned even farther outside relative to the position of seal member 24 shown in FIG. 7; hence waterproof connector 10 becomes bulky overall.

In light of the above, the present invention has the object of presenting a waterproof connector which at least doublelocks the male housing and which is miniaturized by providing a latch arm inserted into an aperture in the female housing.

SUMMARY OF THE INVENTION

In order to achieve the above-noted object, this invention's connector is one characterized by being made up of a female housing equipped with an engaging aperture and a male housing equipped with a latch arm on one side to lock with the said female housing and to prevent the engaged parts from coming apart when inserted into the aperture and engaged with the female housing, and which is equipped with a double lock member inserted from the side opposite to the first side and locking the internal contacts.

The instant invention is further characterized by being equipped with a male housing with sides surrounded by a seal member slanted so that on the first side the seal member is ahead of the latch arm in the insertion direction, and on the other side the seal member is to the rear of the double lock member in the insertion direction so that it is waterproof when engaged inside the aperture.

If a latch arm that is inserted into the female housing aperture is provided, a part that adheres to the seal member (hereafter the part that adheres to this seal member is referred to as "seal unit") cannot be provided at that latch arm part. Usually the double lock member is inserted from the side toward the housing engagement direction, but, when this double lock member is provided, it is also necessary to waterproof the part where this double lock member is inserted.

The instant invention is designed so that it is equipped with a latch arm on one side of the male housing, and a double lock member inserted from the other side opposite the first side. On the side equipped with the latch arm the seal unit is positioned farther forward in the engaging direction than the latch arm, and, on the other side where the double lock member is inserted, the seal unit is positioned farther to the rear in the engaging direction than the double lock member. Another seal unit is provided which joins the first side's seal unit and the other side's seal unit, and which is slanted relative to the entire assembly and which surrounds the sides of the male housing. This invention is also equipped with a seal member which adheres to the seal unit inside the aperture in the female housing. Thus the male housing is equipped with a latch arm which is inserted into an aperture in the female housing, and the preventive connector is miniaturized. Also, a double lock member is provided in the waterproof part of the male housing, and this makes the protection against the contact coming out even more reliable.

DETAILED DESCRIPTION OF THE INVENTION

Figure 1:
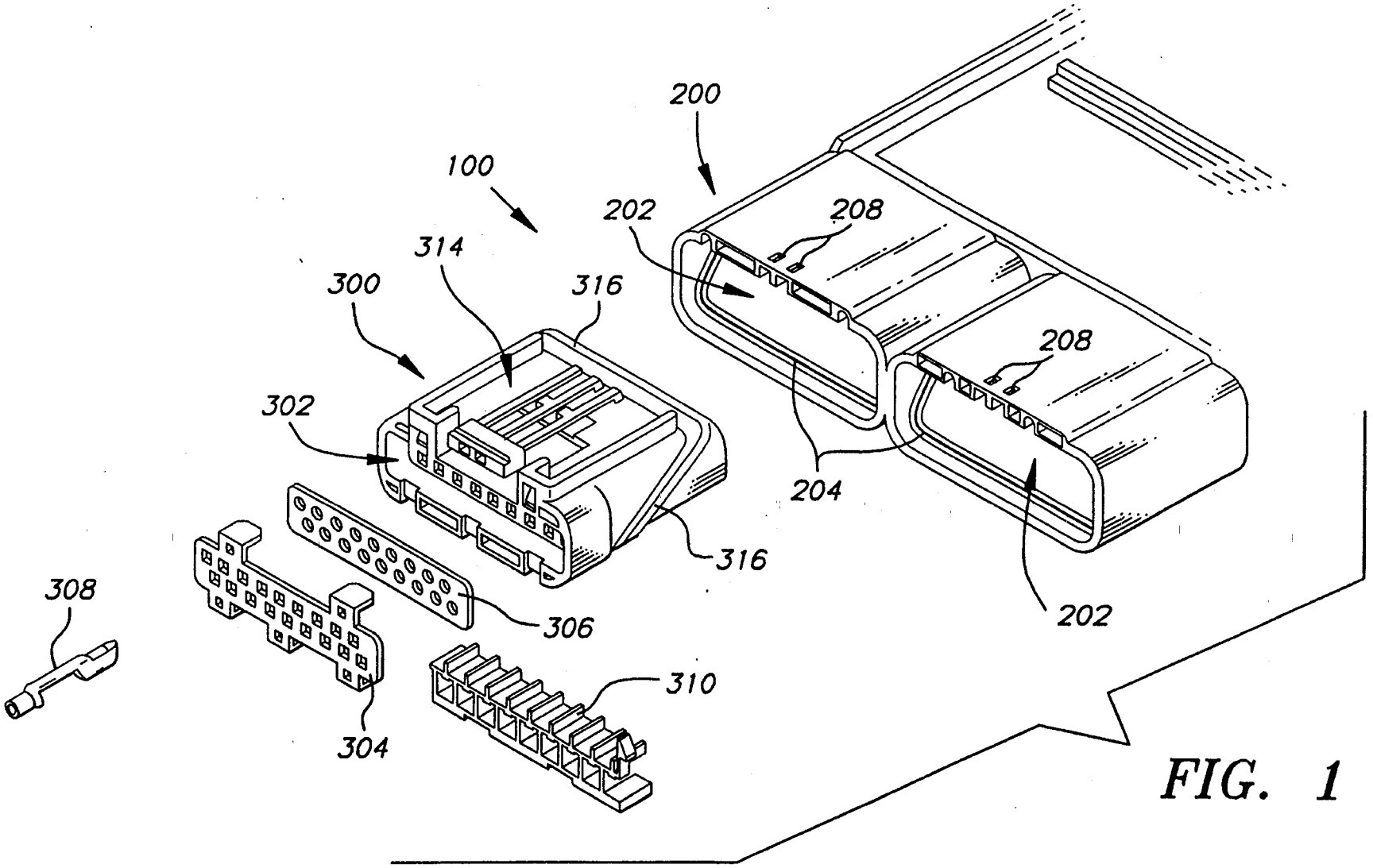
FIG. 1 is a disassembled oblique view of one working example of a waterproof connector related to the present invention.

FIG. 1 is a disassembled oblique view showing one working example of a waterproof connector. The waterproof connector 100 is made up of female housing 200 and male housing 300. In this working example, female housing 200 is equipped with two apertures 202 into which male housings 300 are inserted, but in order to avoid complexity in the illustration only one male housing 300 is shown.

Contact 308 passes through the hole in cover 304 and the hole in waterproof rubber plug 306 and is inserted from aperture 302 in the rear of male housing 300. Rubber plug 306 is fitted into the aperture 302, and its surface is covered by cover 304. Contact 308, inserted into male housing 300, is locked by lance 312 (see FIG. 5) and secured at a specific position inside male housing 300. Double lock member 310 is inserted into male housing 300 from below in FIG. 1, and contact 308 is locked by this inserted double lock member 310, thereby completely preventing contact 308 from coming out.

Figure 7:
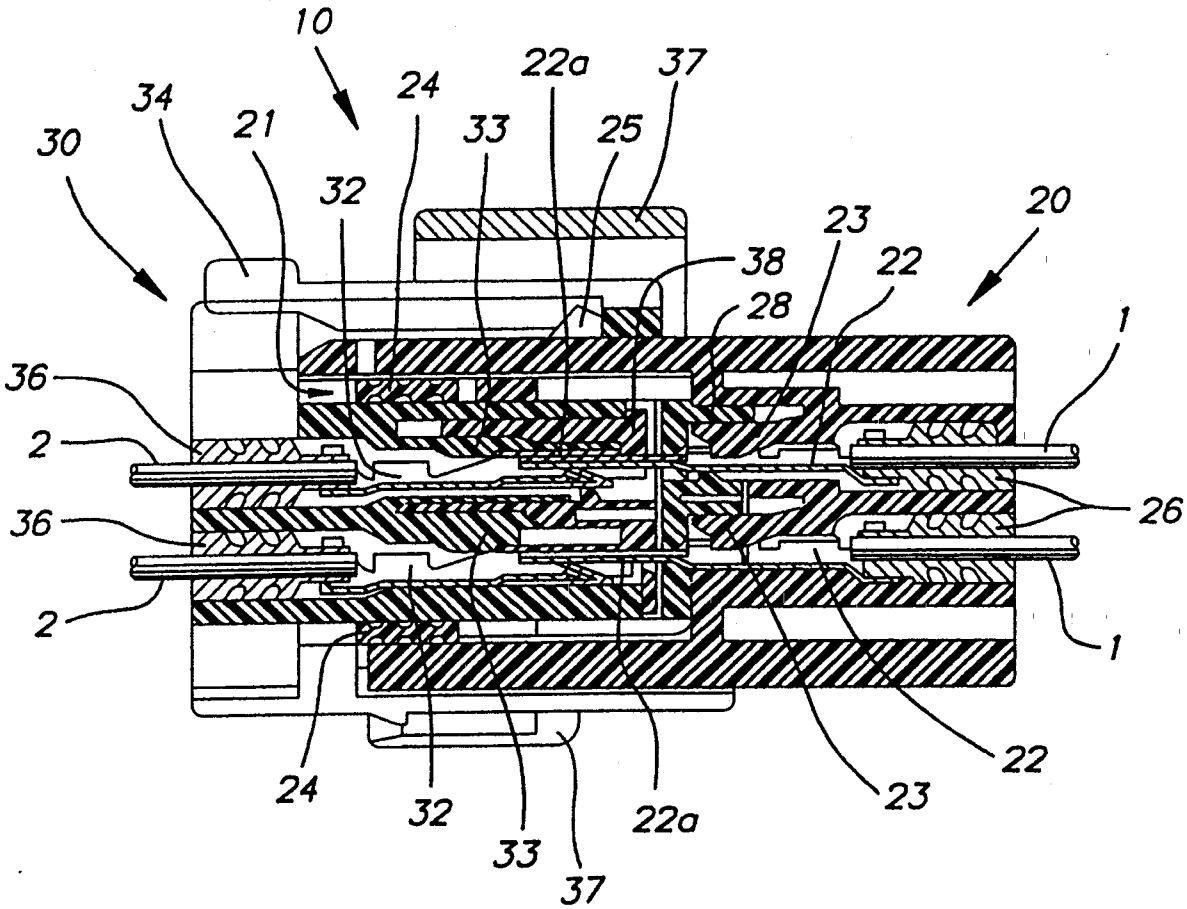
FIG. 7 (PRIOR ART)
FIG. 7 is a cross-sectional view showing one example of a prior-art waterproof connector.

This male housing 300 is also equipped with latch arm 314 from the top of FIG. 1. When engaged, this latch arm 314 enters the aperture in female housing 200 and engages with lock hole 208 provided at a corresponding position in female housing 200, which prevents the engagement of housings 200 and 300 from accidentally coming apart. The surface of male housing 300 equipped with latch arm 314 is also equipped with seal unit 316, which is farther forward in the engaging direction than latch arm 314. Seal unit 316 is provided in the bottom surface in FIG. 1, that is, in the surface where double lock member 310 is inserted farther to the rear in the engaging direction than double lock member 310. Seal unit 316 is shaped so that it slants on the left and right sides to connect seal unit 316 on the top and bottom. In this case seal unit 316 is formed as a single unit using a different material than the material of male housing 300, for example, plastic reinforced with carbon fiber, etc. Seal unit 316 in this working example uses a hard material, which prevents damage to the seal unit; therefore it is not necessary to provide hood 37, etc. as in the previously described example of prior art (see FIG. 7). Combined with the structure that inserts latch arm 314 into aperture 202 in female housing 200, this waterproof connector 100 is miniaturized even more. Seal member 204 is arranged inside aperture 202 in female housing 200 at a position where it adheres with seal unit 316 when engaged.

Figure 2:
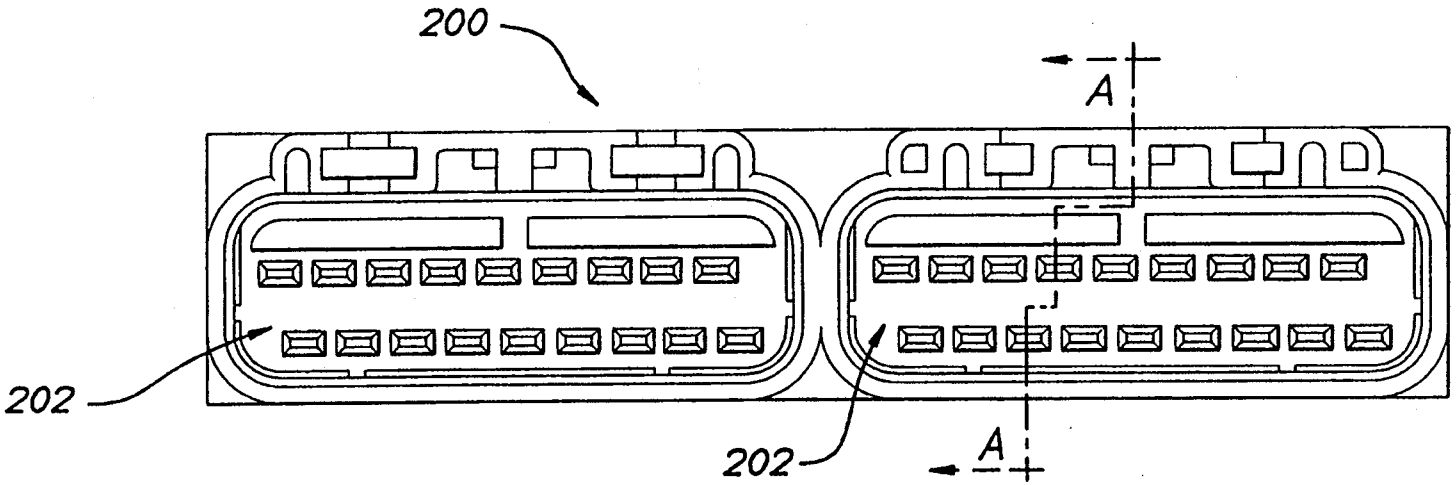
FIG. 2 is a view of the female housing shown in FIG. 1, seen from the front of the aperture.
Figure 3:
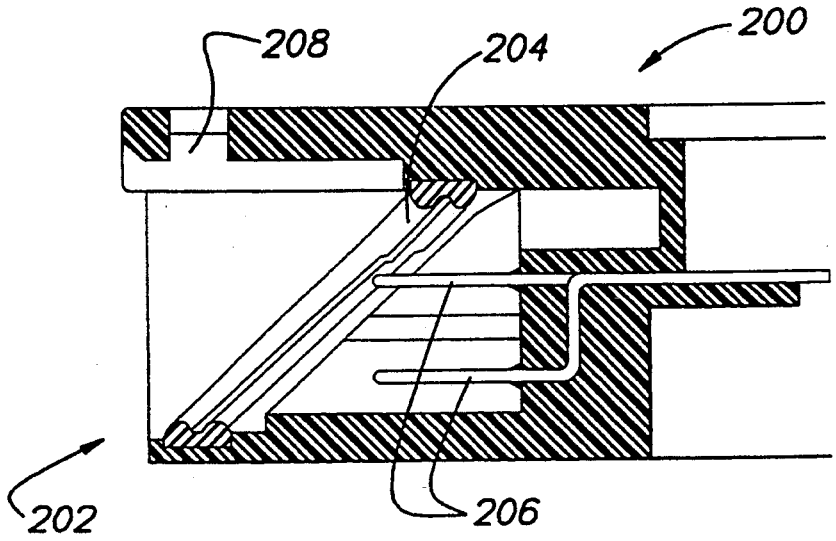
FIG. 3 is a cross-sectional view shown along line A—A in FIG. 2.

FIG. 2 is a view of aperture 202 in female housing 200 seen from the front. FIG. 3 is a cross-sectional view along A—A in FIG. 2. In housing 200, as shown in FIG. 3, pinshaped contact 206 is provided so that it projects into aperture 202, and seal member 204 is provided inside aperture 202 to adhere with male housing 300's seal unit 316 (shown in FIG. 1) when engaged. Lock hole 208 is in the upper part of aperture 202 in FIG. 3, and locking projection **314*a* (see FIG. 5) enters lock hole 208 when engaged. This keeps female housing 200 and male housing 300** from coming apart.

Figure 4:
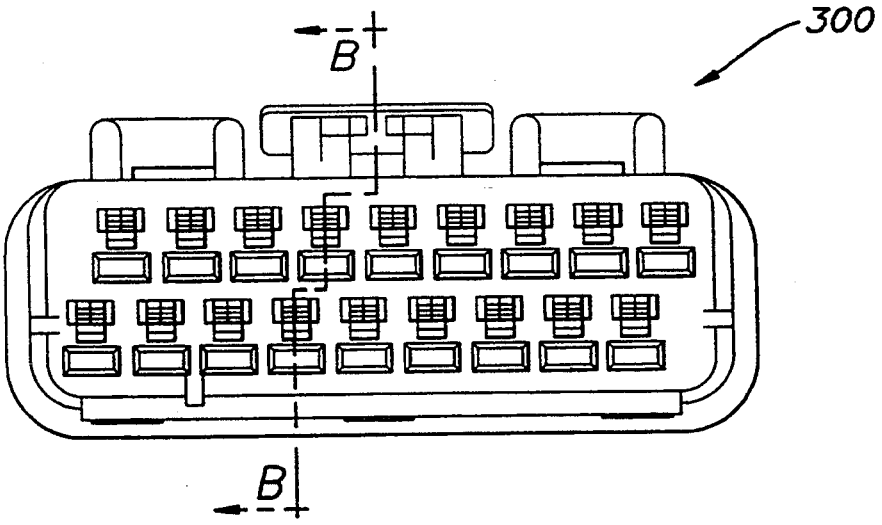
FIG. 4 is a view of the male housing in FIG. 1, seen from the engaging side.
Figure 5:
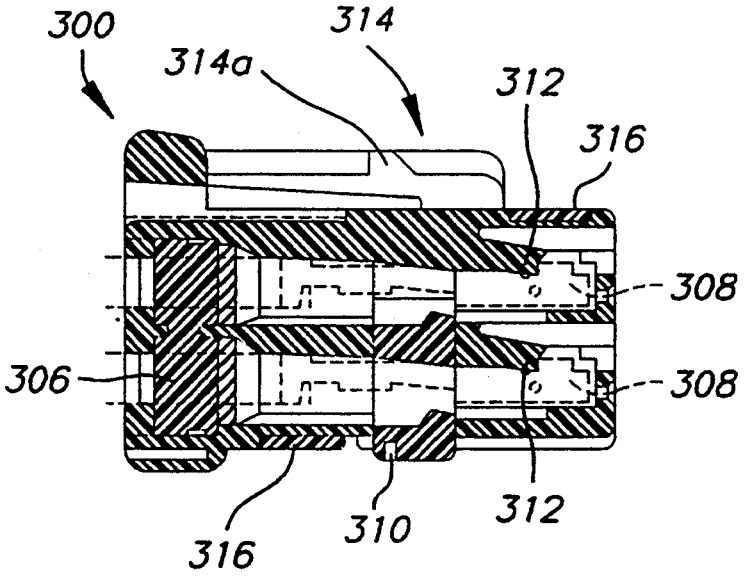
FIG. 5 is a cross-sectional view shown along line B—B in FIG. 4.
Figure 6:
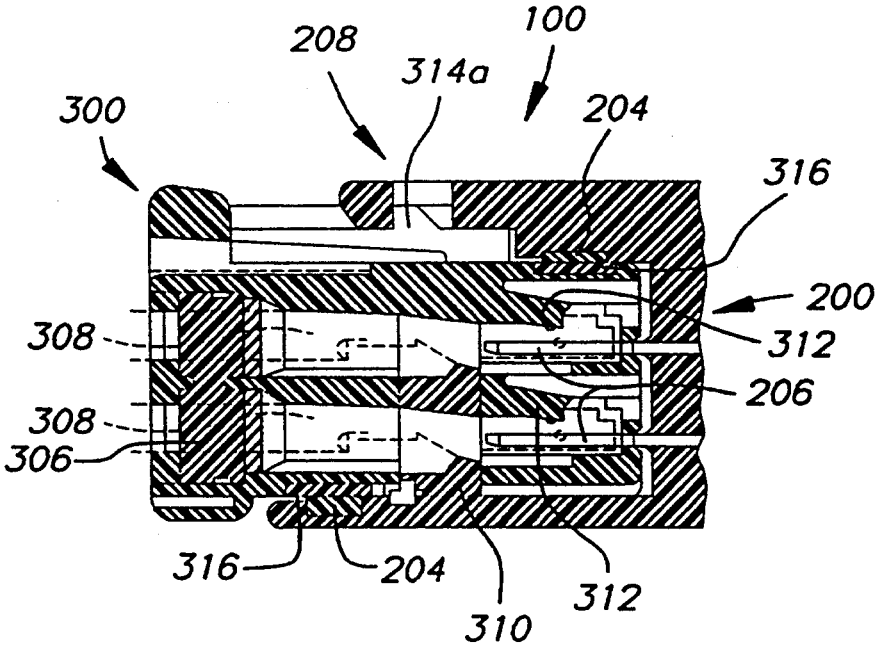
FIG. 6 is a cross-sectional view of female housing 200 and male housing 300 when engaged.

FIG. 4 is a view showing male housing 300 from the engaging face side. FIG. 5 is a cross-sectional view along B—B in FIG. 4. FIG. 6 is a cross-sectional view of female housing 200 and male housing 300 in an engaged state.

FIG. 5 is a view showing the situation before double lock member 310 has been completely inserted. Contact 308, inserted into male housing 300, is locked by lance 312, and inserting double lock member 310 from the bottom of FIG. 5 also locks it by double lock member 310 as shown in FIG. 6, thereby completely preventing contact 308 from coming out.

Seal unit 316 is also provided on male housing 300 in FIGS. 5 and 6; on the top it is forward in the engaging direction and on the bottom it is to the rear of the engaging direction. When engaged, as shown in FIG. 6, seal member 204 adheres to the seal unit 316, thereby waterproofing both the connecting part of contacts 206 and 308 and the part with the double lock member inserted. The male housing's rear end (relative to the engaging direction) is waterproofed by rubber plug 306, and the female housing's rear end may be waterproofed if required.

Furthermore, in the above working example, seal member 204 was provided inside aperture 202 in female housing 200, but a slanted seal member around the outside of male housing 300 may also be provided. In this case female housing 200's seal unit is inside the partition forming aperture 202 and is protected, so it isn't necessary to form it from a material different from the housing.

As explained above, this invention's waterproof connector is equipped with a surrounding seal member slanted so that on the side of the male housing equipped with a latch arm the seal member is ahead of the latch arm in the insertion direction, and on the side opposite the first side the seal member is to the rear of the double lock member in the insertion direction so that it is waterproof when inserted into the aperture, and the male housing is equipped with a latch arm which is inserted into the aperture. This achieves a waterproof connector which is miniaturized and which reliably prevents contact from coming out.

Also, if the male housing shield unit is formed in one piece using a hard material as shown in the above working example, the hood which protects this shield unit can be omitted, producing a waterproof connector which is even more miniaturized.

I claim:

1. An electrical connector having first and second matable connector halves having an axial insertion direction for matable engagement with each other, comprising:

a first matable connector half comprising a male member with electrical contacts and a first seal disposed along exterior side surfaces of said male member;

a second matable connector half comprising a female member with electrical contacts disposed therein and arranged for electrical contact with said male member contacts, and further including an aperture for matably receiving said male member;

a lock arm member formed on one of said matable connector halves, wherein the lock arm member is operatively disposed for releasable engagement with the other of said matable connector halves; and wherein said seal is generally band-shaped and has a longitudinal band-axis therein positioned generally around said male member with at least a portion of said seal longitudinal band-axis, which portion passes along at least one exterior side surface of said male member, being aligned at an acute angle relative to said axial insertion direction.

2. The electrical connector of claim 1, wherein a double lock member is provided in the male member for engaging the contacts when the male member is in the inserted position.

3. The electrical connector of claim 1, wherein a portion of the first seal is located forwardly of the lock arm.

4. The electrical connector of claim 1, wherein the first seal is made of the same material as the male member.

5. The electrical connector of claim 1, wherein a second seal is provided in the female member aperture for sealing engagement with the first seal when the male member is in the inserted position.

6. The electrical connector of claim 5, wherein a portion of each seal is located forwardly of the lock arm, and a portion of each seal is located rearwardly of the double lock member when the male member is in the inserted position.

7. The electrical connector of claim 1, wherein the lock arm is pivotably mounted to the male member and includes a ramped projection which causes the lock arm to pivot when the male member is inserted into the aperture.

8. The electrical connector of claim 7, wherein the ramped projection snaps into a locking aperture when the male member is in the inserted position thereby locking the male member to the female member.

9. An electrical connector having first and second matable connector halves having an axial insertion direction for matable engagement with each other, comprising:

a first matable connector half comprising a male member with electrical contacts and a first seal disposed along exterior side surfaces of said male member;

a second matable connector half comprising a female member with electrical contacts disposed therein and arranged for electrical contact with said male member contacts, and further including an aperture for matably receiving said male member;

wherein said first seal is generally band-shaped and has a longitudinal band-axis therein positioned generally around said male member thereby defining a plane of said first seal; and wherein a double lock member is provided in the male connector half and has an insertion direction which is generally transverse to said axial insertion direction of said connector halves, and which double lock member insertion direction is at an acute angle relative to the plane of said first seal.

10. The electrical connector of claim 9, wherein the first seal is made of the same material as the male member.

11. The electrical connector of claim 9, further comprising latching arms disposed in the male member for primary latching of the contacts.

12. The electrical connector of claim 9, wherein a second seal is provided in the female member aperture for sealing engagement with the first seal when the male member is in an inserted position.

13. The electrical connector of claim 12, wherein a portion of the second seal is located forwardly of the lock arm, and a portion of the second seal is located rearwardly of the double lock member when the male member is in the inserted position.

14. The electrical connector of claim 9, wherein the lock arm is pivotally mounted to the male member and includes a ramped projection which causes the lock arm to pivot when the male member is inserted into the aperture.

15. The electrical connector of claim 14, wherein the ramped projection snaps into a locking aperture when the male member is in an inserted position thereby locking the male member to the female member.

16. An electrical connector having first and second matable connector halves having an axial insertion direction for matable engagement with each other, comprising:

a first matable connector half comprising a male member with electrical contacts and a first seal disposed along exterior side surfaces of said male member;

a second matable connector half comprising a female member with electrical contacts disposed therein and arranged for electrical contact with said male member contacts, and further including an aperture for matably receiving said male member;

and wherein said first seal is generally band-shaped and has a longitudinal band-axis therein positioned generally around said male member thereby defining a plane of said first seal so that the plane of said first seal is offset at an acute angle relative to said axial insertion direction of said matable halves.

17. The electrical connector of claim 16, wherein said male member has a lock arm member wherein the lock arm member is disposed generally within an aperture of the female member when the male member is in an inserted position.

18. The electrical connector of claim 17, wherein a double lock connector is provided in said male member for securing said contacts in said male member.

19. The electrical connector of claim 18, wherein a portion of said first seal is located forwardly of said lock arm and a portion of said second seal is located rearwardly of said double lock connector.

20. The electrical connector of claim 18, wherein a second seal is provided in the female member for sealing engagement with the first seal when the male member is in the inserted position.

21. The electrical connector of claim 20, wherein a portion of said second seal is located forwardly of the lock arm, and a portion of the second seal is located rearwardly of the double lock member when the male member is in the inserted position.

* * * * *